US007340205B2

(12) United States Patent
Nagao et al.

(10) Patent No.: US 7,340,205 B2
(45) Date of Patent: Mar. 4, 2008

(54) FULL-COLOR ELECTROPHOTOGRAPHIC IMAGE FORMING APPARATUS

(75) Inventors: Taisuke Nagao, Osaka (JP); Hisashi Mukataka, Osaka (JP); Eiji Gyoutoku, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 76 days.

(21) Appl. No.: 11/353,102

(22) Filed: Feb. 14, 2006

(65) Prior Publication Data

US 2006/0188289 A1 Aug. 24, 2006

(30) Foreign Application Priority Data

Feb. 18, 2005 (JP) ..... 2005-041461

(51) Int. Cl.
*G03G 15/16* (2006.01)
*G03G 15/22* (2006.01)

(52) U.S. Cl. ..... 399/296; 399/130

(58) Field of Classification Search ..... 399/130, 399/231, 296

See application file for complete search history.

(56) References Cited

U.S. PATENT DOCUMENTS 5,558,970 A * 9/1996 Landa et al. ..... 399/296 X
5,926,679 A * 7/1999 May et al. ..... 399/231 X
6,496,676 B1 * 12/2002 Caruthers et al. ..... 399/296
6,965,747 B2 * 11/2005 Funamizu et al. ..... 399/296 X

FOREIGN PATENT DOCUMENTS

| | | |
|---|---|---|
| JP | 07-261568 | 10/1995 |
| JP | 2001-060044 | 3/2001 |
| JP | 2003-263069 | 9/2003 |

* cited by examiner

*Primary Examiner*—Sandra L. Brase
(74) *Attorney, Agent, or Firm*—Smith, Gambrell & Russell, LLP

(57) ABSTRACT

In image formation of a black-line image, the image is developed with black toner, and in addition parts of the black-line image corresponding to an intersection between at least two black lines and a middle portion of a black line are developed with toner of at least one of cyan, yellow, and magenta colors overlaid. This makes it possible to prevent central voids in a black-line image. In a black-line image transferred onto a transfer medium by this full-color image forming apparatus, not only are central voids eliminated, but degradation of image quality is also prevented.

7 Claims, 5 Drawing Sheets

FULL-COLOR ELECTROPHOTOGRAPHIC IMAGE FORMING APPARATUS

This application is based on Japanese Patent Application No. 2005-041461 filed on Feb. 18, 2005, the contents of which are hereby incorporated by reference.

BACKGROUND OF THE INVENTION

1. Field of the Invention

The present invention relates to a full-color image forming apparatus, such as a copier, printer, or facsimile machine, that achieves image formation by electrophotography, and more particularly to a full-color image forming apparatus that can prevent "central voids."

2. Description of Related Art

In image forming apparatuses, such as copiers and printers, that rely on electrophotography, when a toner image developed on a photoconductive member is transferred, a phenomenon called "central voids" is known to occur, the term denoting the failure of transfer in, for example, a middle part of a character or a line. This phenomenon is associated with the pressure applied during the transfer process, and, when this pressure is high, as when toner is transferred directly from a photoconductive member onto a comparatively thick printing medium such as a thick sheet of paper or an OHP sheet, or when toner is transferred onto an intermediary transfer belt built with a resin belt, central voids are likely to occur. Moreover, since central voids result from flocculation of toner, they are particularly likely to occur in characters, parts where fine lines intersect, and in similar parts, where, under the influence of the edge effect, toner tends to adhere in large amounts and thus tends to flocculate.

Central voids are associated with the flocculation of toner as described above, and are therefore believed to be associated with some factors in toner; in particular, the shape of toner particles is known to be associated with central voids. Toner produced by polymerization is generally believed to have a round toner particle shape, and using such toner leads to a low incidence of central voids. In particular, using toner produced by suspension polymerization and thus having a nearly spherical toner particle shape tends to result in a considerably low incidence of central voids. Even when polymerized toner is used, however, central voids do occur in some cases. In a system in which toner remaining on a photoconductive member is wiped off with a rubber plate, the more round the toner particle shape, the more easily the toner is stuck in the nip between the photoconductive member and the rubber plate, making cleaning difficult.

In view of the facts noted above, some proposals have been made for the prevention of central voids. For example, Japanese Patent Application Laid-open No. 2003-263069 (hereinafter referred to as Patent Publication 1) proposes an image forming apparatus in which lubricant is applied to a photoconductive member and development is performed by using toner containing similar lubricant. This image forming apparatus, however, builds on an expensive construction. Moreover, the lubricant, specifically a metal salt of a fatty acid, is highly hygroscopic, and therefore, for example in an image forming apparatus employing an amorphous silicon photoconductive member, as the lubricant absorbs moisture, the surface resistance of the photoconductive member lowers, making blurred edges and other image defects more likely.

Also proposed are image forming apparatuses in which, when a toner image formed on a photoconductive member is transferred, the pressure applied to developer toner on the photoconductive member can be lessened. For example, Japanese Patent Application Laid-open No. 2001-60044 (hereinafter referred to as Patent Publication 2) proposes an image forming apparatus that includes an intermediary transfer drum composed of an electrically conductive cylinder built as a rigid cylindrical member, at least two electrically conductive elastic layers laid on the outer circumferential surface of the electrically conductive cylinder, and a toner-releasing layer applied to the outer circumferential surface of the electrically conductive elastic layers. Structured in this way, the intermediary transfer drum, even in combination with a photoconductive drum, does not cause an increase in the maximum nip pressure, and thus helps prevent central voids.

On the other hand, Japanese Patent Application Laid-open No. H7-261568 (hereinafter referred to as Patent Publication 3) proposes an image forming apparatus in which an elastic member having a hardness of JIS A 40° or more but 80° or less is used as a middle layer of a member with which an intermediary transfer member is built. This helps lessen the pressure applied during the transfer process, and thus helps prevent central voids. These image forming apparatuses, however, build on a construction that requires an intermediary transfer drum. Considering that a construction employing an intermediary transfer belt is currently popular because it allows an image forming apparatus to be made compact, applying the construction disclosed in Patent Publication 2 or 3 to such a construction, as long as the belt is built as a elastic member, only tends to cause extension of the belt and the like, resulting in color shifts and the like.

Incidentally, in full-color image forming apparatuses, central voids are commonly observed regardless of the color of characters, fine lines, or the like. In characters or the like that are formed with toners of two or more colors overlaid, however, central voids tend to occur at lower incidences, and, in characters or the like formed with toner of a single color, even if central voids occur, thanks to the color, they tend to be inconspicuous. Thus, as compared with when development is performed with toner of a single, black color, measures against central voids tend to be less necessary when development is performed with toner of other colors. That is, measures against central voids tend to be particularly necessary in black characters and the like.

SUMMARY OF THE INVENTION

In view of the conventionally encountered inconveniences discussed above, it is an object of the present invention to provide a full-color image forming apparatus that can effectively prevent central voids in an black-line image containing black characters, for which measures against central voids are believed to be particularly necessary, while minimizing degradation of image quality without greatly changing the construction of a conventionally proposed full-color image forming apparatus. It is another object of the present invention to provide, as a full-color image forming apparatus constructed to include an intermediary transfer belt as popularly practiced for compactness and other reasons, one that can prevent central voids.

To achieve the above objects, according to the present invention, a full-color image forming apparatus is provided with: an image signal input section for inputting an image signal; an image formation section including an exposure section for shining image light based on the image signal inputted by the image signal input section on an image-carrying member and a development section for developing an electrostatic latent image formed on the image-carrying member by the exposure section; and a control section for controlling driving of the image formation section. Here, when the image signal contains a black-line image, the control section develops the black-line image with black toner and in addition develops part of a line forming the black-line image with toner of another color laid over the black toner. Here, a line image denotes an image composed of lines, such as characters and geometric figures, and a black-line image denotes a black line image.

With this construction, it is possible to prevent central voids in a black-line image, for which measures against central voids are believed to be necessary, while minimizing degradation of the image quality of the black-line image without greatly changing the construction of a conventionally proposed full-color image forming apparatus.

According to the present invention, in the full-color image forming apparatus constructed as described above, the part of the line forming the black-line image may be a part corresponding to an intersection between at least two black lines and/or a middle portion of a black line.

With this construction, in an intersection between black lines and in a middle portion of a black line, where central voids are particularly likely to occur, development is performed also with the toner of the other color. This makes it possible to effectively prevent central voids.

According to the present invention, in the full-color image forming apparatus constructed as described above, the toner of the other color may be toner of at least one of yellow, magenta, and cyan colors.

With this construction, it is possible to effectively prevent central voids by using yellow, magenta, and cyan toners, which are commonly provided in a full-color image forming apparatus. In particular, since mixing the three colors, namely yellow, magenta, and cyan, produces black, by using the toners of these colors simultaneously as the toner of the other color, it is possible to prevent central voids while the black-line image transferred onto a transfer medium such as paper is left in a state in which it is recognized as very close to one formed with the black toner alone.

According to the present invention, in the full-color image forming apparatus constructed as described above, the black toner may be produced by crushing, and the toner of the other color by polymerization.

With this construction, even when, as the black toner, toner produced by crushing and thus more likely to cause central voids because of indefinite toner particle shapes and thus a smaller content of spherical toner particles as compared with toner produced by polymerization is used, it is possible to effectively prevent central voids in a black-line image.

According to the present invention, in the full-color image forming apparatus constructed as described above, there may be further provided an intermediary transfer member. Here, the electrostatic latent image formed on the image-carrying member is developed with toner of corresponding colors by the development section, and then the resulting toner images are first transferred one over another onto the intermediary transfer member, and are then transferred all at once onto a transfer medium.

With this construction, even in a full-color image forming apparatus including an intermediary transfer member, it is possible to effectively prevent central voids in a black-line image without greatly changing the construction of the apparatus.

According to the present invention, in the full-color image forming apparatus constructed as described above, the intermediary transfer member may be a belt.

With this construction, in a full-color image forming apparatus constructed to include an intermediary transfer belt as popularly practiced for compactness and other reasons, it is possible to effectively prevent central voids.

According to the present invention, in the full-color image forming apparatus constructed as described above, when the image signal represents a monochrome image, the control section may, instead of developing the part of the line forming the black-line image with the toner of the other color laid over the black toner, perform development with a smaller amount of black toner than when forming a full-color image. Here, a monochrome image denotes an image formed with black toner alone.

With this construction, when a monochrome image is formed, image formation is performed by using only a developer unit loaded with the black toner. Thus, it is possible to form monochrome images with higher productivity. Moreover, when a monochrome image is formed, a reduced amount of black toner is used. Thus, it is possible to prevent central voids. On the other hand, when a full-color image is formed, development is performed with the toner of the other color overlaid in the part of the line forming the black-line image. Thus, also in this case, it is possible to prevent central voids. That is, it is possible to effectively prevent central voids in a black-line image while increasing productivity in the apparatus as a whole.

DETAILED DESCRIPTION OF PREFERRED EMBODIMENTS

Figure 1:
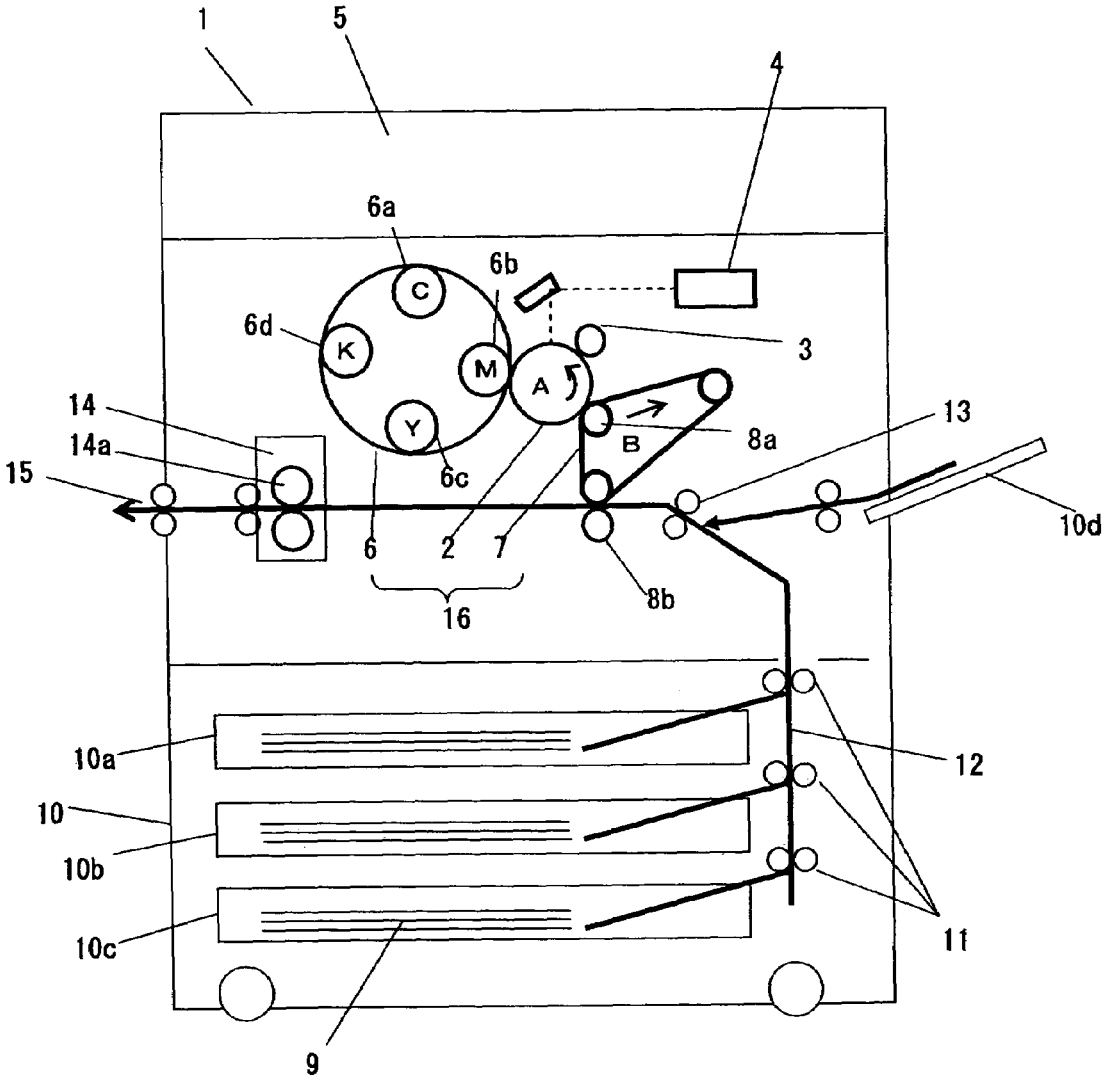
FIG. 1 is a diagram schematically showing the construction of a full-color image forming apparatus according to the present invention.

Hereinafter, an embodiment of the present invention will be described with reference to the drawings. FIG. 1 shows, as one example of a full-color image forming apparatus embodying the present invention, a rotary-development-type full-color image forming apparatus. Needless to say, the present invention may be applied to a tandem-type image forming apparatus.

In the full-color image forming apparatus 1, when copying is performed, inside the body of the apparatus, a photoconductive drum 2 that rotates in the direction indicated by arrow A in the figure is electrically charged uniformly by a charger unit 3. Then, according to document image data scanned by an image scanning section 5, an electrostatic latent image is formed on the photoconductive drum 2 by a laser beam from an exposure unit 4.

Developer (hereinafter referred to as toner) is fed onto the photoconductive drum 2 by a rotary-type developer unit 6. The developer unit 6 is provided with developer cartridges 6*a*, 6*b*, 6*c*, and 6*d* for different colors, namely cyan, magenta, yellow, and black, each having a developing device and a toner container integrated together. The developer cartridges 6*a* to 6*d* are so rotated as to face, one after another, the photoconductive drum 2. Meanwhile, toner adheres to the electrostatic latent image on the photoconductive drum 2, and forms toner images of the different colors.

The toner images are transferred onto an intermediary transfer belt 7, which is rotated in the direction indicated by arrow B by unillustrated driving means while being kept in contact with the photoconductive drum 2. Used as the intermediary transfer belt 7 is one formed of a sheet of resin such as polycarbonate, for example an endless belt formed by putting and joining together the ends of a strip, or a seamless belt.

When the user requests the start of image formation, with predetermined timing, a cyan toner image is formed on the photoconductive drum 2. Then, an electric field is applied to the intermediary transfer belt 7 at a predetermined transfer voltage, and then the cyan toner image on the photoconductive drum 2 is transferred onto the intermediary transfer belt 7 by a primary transfer roller 8*a*. Subsequently, the toner remaining on the surface of the photoconductive drum 2 is removed by a cleaning section (unillustrated), and then the developer unit 6 rotates through a predetermined angle. Now, in the same manner as described above, a magenta toner image is formed on the photoconductive drum 2, and is then transferred onto the intermediary transfer belt 7.

Subsequently, in the same manner as described above, an yellow and a black toner image are transferred onto the intermediary transfer belt 7 by the photoconductive drum 2. These four-color images are formed with a predetermined positional relationship that is so prescribed as to form a predetermined full-color image.

Toward the intermediary transfer belt 7 having the toner images formed thereon as describe above, paper 9 is conveyed from a paper feed mechanism 10 via paper feed rollers 11, a paper feed passage 12, and a pair of resist rollers 13. The toner images formed on the surface of the intermediary transfer belt 7 are then transferred onto the paper 9 by a secondary transfer roller 8*b*. The paper 9 having the toner images transferred thereon is then conveyed to the a fixing section 14 provided with a pair of fixing rollers 14*a*, so that the toner images are fixed. Having passed through the fixing rollers 14*a*, the paper is ejected to a paper ejection section 15.

The paper feed mechanism 10 is located in a lower part of the full-color image forming apparatus 1, and is provided with paper cassettes 10*a*, 10*b*, and 10*c* for storing paper 9 and a stack bypass (hand-feed tray) 10*d* provided above them.

Figure 2:
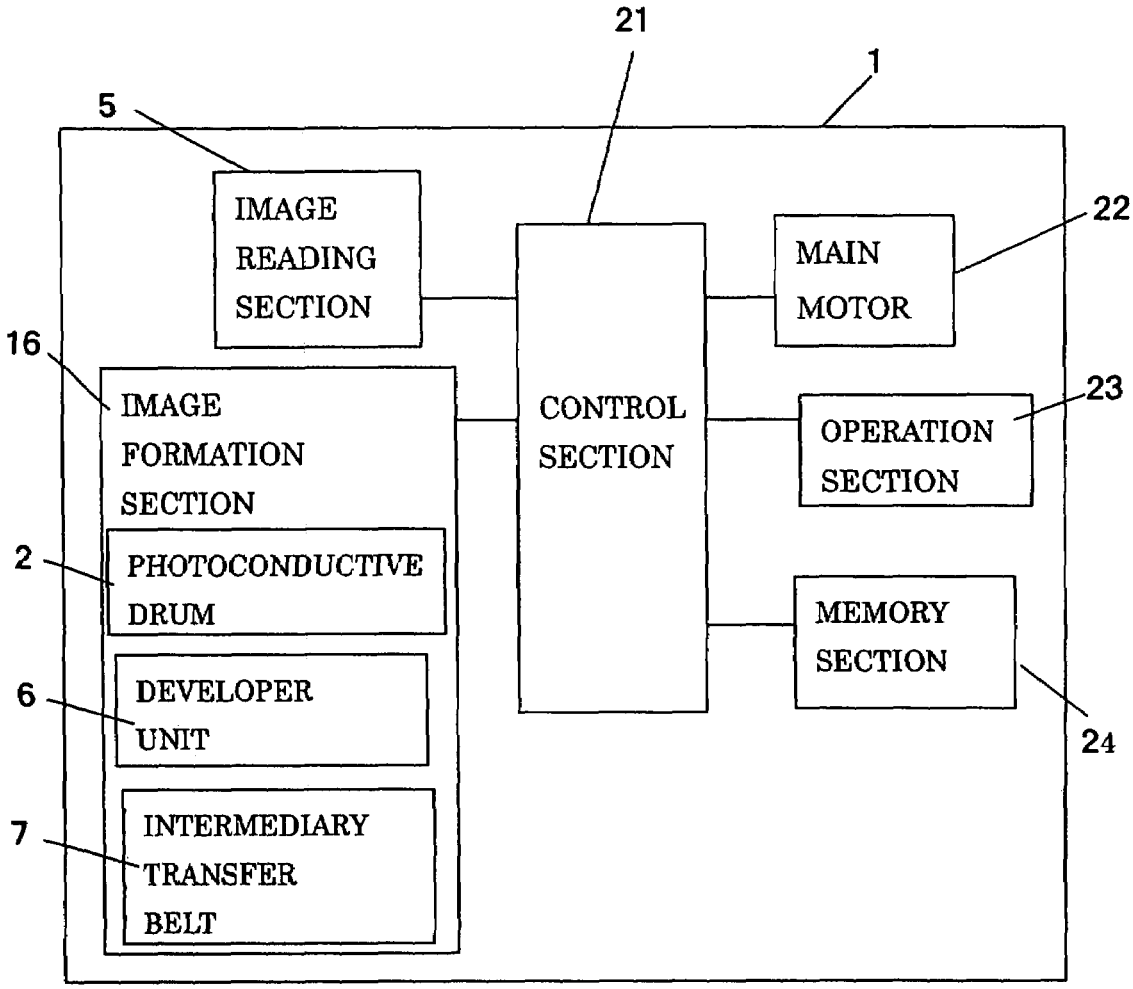
FIG. 2 is a block diagram showing the configuration of the full-color image forming apparatus according to the present invention.

FIG. 2 is a block diagram showing the configuration of the full-color image forming apparatus 1 of this embodiment. Such parts as are found also in FIG. 1 are identified with common reference numerals, and no description thereof will be repeated. As shown in FIG. 2, the full-color image forming apparatus 1 includes: an image scanning section 5; an image formation section 16 having a photoconductive drum 2, an developer unit 6, and a intermediary transfer belt 7; a control section 21; a main motor 22; an operation section 23, and a memory section 24.

The image scanning section 5 includes: a scanning optical system incorporating a scanner lamp for illuminating a document during copying and a mirror for changing the optical path of the light reflected from the document; a condenser lens for condensing and focusing the light reflected from the document; and a CCD or the like for converting the focused image light into an electrical signal. That is, the image scanning section 5 functions as an image signal input section that scans image data and then inputs an image signal to the control section 21.

According to signals from the operation section 23, the control section 21 controls the operation of the different parts, such as the image scanning section 5 and the image formation section 16, of the full-color image forming apparatus 1. Moreover, based on the data read by the image scanning section 5, the control section 21 also controls the operation of the image formation section 16 so as to prevent central voids as will be described later.

According to control signals from the control section 21, the main motor 22 drives the photoconductive drum 2, the transfer rollers 8*a* and 8*b* (see FIG. 1), the fixing rollers 14*a* (see FIG. 1), and the like. The operation section 23 includes operation keys (unillustrated) with which the user makes settings on the apparatus's operation, printing conditions, and the like and a display section (unillustrated) for displaying the set conditions and the apparatus's status. The memory section 24 stores programs used by the control section 21 to control the different parts of the full-color image forming apparatus 1.

Figure 3:
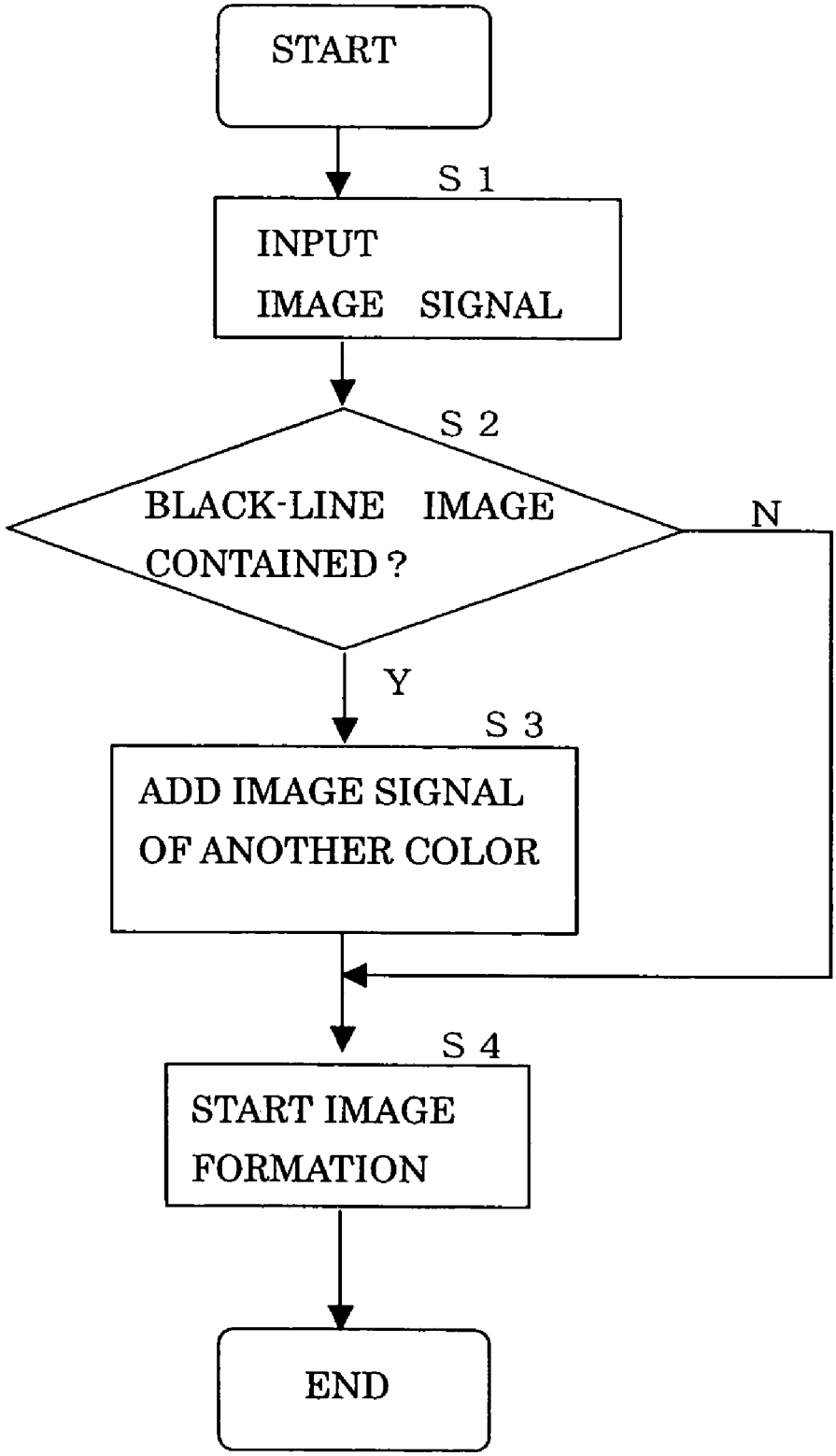
FIG. 3 is a flow chart showing the control performed to prevent central voids in a first embodiment of the present invention.

Next, as a first embodiment of the present invention, an example of how central voids in a black-line image are prevented in the full-color image forming apparatus 1 will be described. In the first embodiment, central voids are prevented by developing a black-line image, in which central voids tend to be conspicuous, with black toner and in addition developing part of the black-line image with toner of another color. Now, the flow of operations for preventing central voids will be described specifically with reference to the flow chart in FIG. 3 in combination with FIG. 2.

First, an image signal read by the image scanning section 5 is fed to the control section 21 (step S1). Then, whether or not the image signal data thus received contains a black-line image is checked (step S2). Here, if a black-line image is recognized to be contained, the control section 21 adds an image signal such that the black-line image is developed with black toner and in addition part of a line forming the black-line image is developed with toner of another color overlaid (step S3). By contrast, if no black-line image is recognized to be contained, no image signal is added. Subsequently, based on the signal outputted from the control section 21, the image formation section 16 starts to form an image (step S4).

Considering that central voids tend to occur in an intersection between lines and in a middle portion of a line, it is preferable that the parts that are developed with the toner of the other color for central void prevention be intersections between at least two lines and middle portions of lines.

In the first embodiment, for central void prevention in a black-line image, as the toner of the other color with which part of a line forming the black-line image is developed, toner of at least one of yellow, magenta, and cyan colors can be used. This, however, is not meant to limit the color of the above-mentioned toner of the other color to those colors. As the toner of the other color, it is preferable to use toner of three, namely yellow, magenta, and cyan, colors, or toner of a single, cyan color, and it is further preferable to use toner of three, namely yellow, magenta, and cyan, colors.

Performing development with yellow, magenta, and cyan toners, each under predetermined conditions, and laying them over one another on the intermediary transfer belt 7 produces black. Thus, for example, when these three colors are transferred over one another in a central void in a black-line image on a transfer medium such as paper, an image is obtained that has a color close to that of an image formed with black toner alone. Even if actually no central void occurs and those three colors are laid over black, the quality of the black-line image is not much degraded. Moreover, laying cyan toner over black toner makes the L value, which is generally used to represent the lightness of a color, lower, and thus produces a darker color. Thus, even when part of a line forming a black-line image is developed with cyan toner overlaid, the resulting image transferred onto a transfer medium such as paper has a color comparatively close to that of an image formed with black toner alone.

Figure 4:
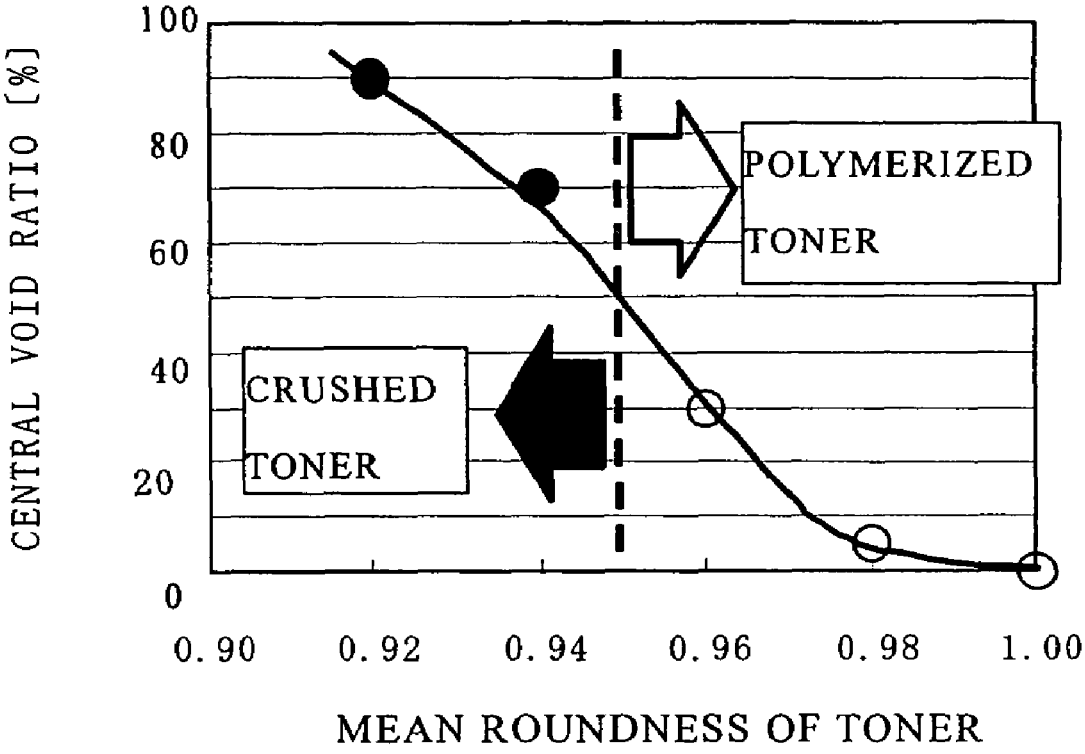
FIG. 4 is a graph showing the relationship between the mean roundness of toner particles and the center void ratio.

In the first embodiment, for example, toner produced by crushing can be used as black toner, and toner produced by polymerization as color toner. With this combination of toners, it is possible to make the most of the advantages offered by the present because, as shown in FIG. 4, central voids are more likely to occur when toner produced by crushing and thus having lower roundness is used, and are comparatively less likely to occur when a toner produced by polymerization and thus having high roundness is used. This, however, is not meant to limit the combination of toners to the one mentioned just above. For example, black toner and color toner both produced by crushing my be combined, or black toner and color toner both produced by polymerization may be combined, or any other combination of toner may be adopted.

FIG. 4 shows the relationship between the mean roundness of toner particles and the central void ratio as observed when image formation is performed in a conventional full-color image forming apparatus. Here, roundness is a quantity calculated by dividing the circumferential length of a circle having the same projection area as the image of a particle by the circumferential length of the projected image of the particle, and was measured on a flow particle image analyzer (model FPIA-2100 manufactured by Sysmex Corporation). The shape of toner particles varies to some degree, and the roundness of toner particles of toner has a distribution. Thus, the mean roundness determined by averaging the roundness of all the particles measured in a single session of measurement is taken along the horizontal axis. The central void ratio is the probability of occurrence of central voids as evaluated in an evaluation image having 100 line-line intersections per page.

The full-color image forming apparatus 1 of the first embodiment is provided with an intermediary transfer belt 7; it may alternatively be provided with, instead of n intermediary transfer belt 7, an intermediary transfer drum; it may even be so constructed, without being provided with an intermediary transfer member such as an intermediary transfer belt or an intermediary transfer drum, as to transfer the toner images on the photoconductive drum 2 directly onto a transfer medium such as paper. That is, with an image forming apparatus of any of those types, the objects of the present invention can be achieved. Considering, however, that the present invention can prevent central voids even in a construction employing a transfer belt, where central voids are more likely to occur under the increased pressure, the present invention more effectively prevents central voids when applied to a full-color image forming apparatus employing a transfer belt.

Next, as a second embodiment of the present invention, a full-color image forming apparatus will be described that is constructed similarly to that of the first embodiment but that performs image formation with black developed on the photoconductive drum 2 under different conditions between when forming a monochrome image and when forming a full-color image. As described previously, the larger the amount of toner that adheres to the photoconductive drum 2 during development, the more likely to occur central voids. Thus, by reducing the amount of toner used for development during image formation, it is possible to prevent central voids. Even then, satisfactory image quality can be retained so long as mostly characters are involved and no solidly colored area. In a solidly colored area, however, reducing the amount of toner used for development during image formation leads to degraded image quality.

Out of the above consideration, in the full-color image forming apparatus of the second embodiment, with a monochrome image containing mostly characters and almost no solidly colored area, the amount of toner used is reduced under black development conditions, and no toner of another color is added with which to develop part of a line forming a black-line image. On the other hand, with a fill-color image, the amount of toner used is not reduced under black development conditions, and, to prevent central voids while retaining the image quality of solidly colored area, part of a line forming a black-line image is developed with toner of another color added.

Figure 5:
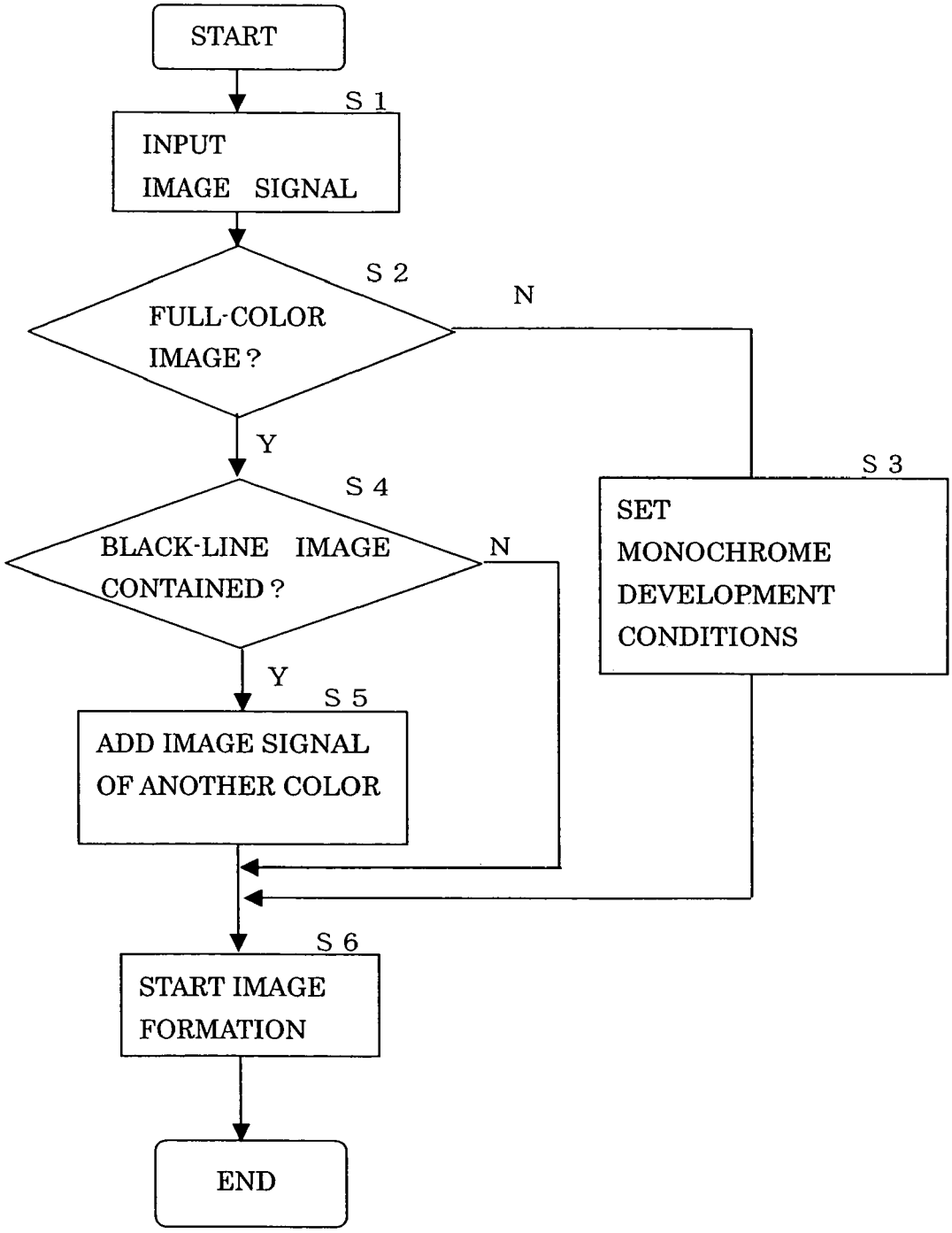
FIG. 5 is a flow chart showing the control performed to prevent central voids in a second embodiment of the present invention.

Now, the flow of operations performed in the full-color image forming apparatus of the second embodiment to prevent central voids will be described specifically with reference to FIG. 5 in combination with FIG. 2. First, an image signal read by the image scanning section 5 is fed to the control section 21 (step S1). Then, whether or not the received image signal represents a full-color image is checked (step S2). If the received image signal does not represent a full-color image, it is recognized as representing a monochrome image, and thus the control section 21 sets black development conditions for monochrome development (step S3).

By contrast, if the received image signal represents a full-color image, then whether or not the image signal data received contains a black-line image is checked (step S4). Here, if a black-line image is recognized to be contained, the control section 21 adds an image signal such that the black-line image is developed with black toner and in addition part of a line forming the black-line image is developed with toner of another color overlaid (step S5). By contrast, if no black-line image is recognized to be contained, no image signal is added. Subsequently, based on the signal outputted from the control section 21, the image formation section 16 starts to form either a monochrome image or a full-color image under development conditions appropriate therefor (step S6).

The full-color image forming apparatus of the second embodiment is characterized in that the control section 21 performs different flows of operations for central void prevention between with a monochrome image and with a fill-color image. Thus, needless to say, within the scope of the objects of the present invention, the second embodiment may be given the same construction as the first embodiment except that the control section 21 checks whether a monochrome image or a full-color image is being dealt with and establishes the development conditions corresponding thereto.

According to the present invention, central voids are prevented by developing part of a line forming a black-line image with toner of another color added. Thus, it is possible to effectively prevent central voids in a black-line image including black characters without greatly changing the construction of a conventional full-color image forming apparatus.

According to the present invention, the part of a line forming a black-line image that is developed with toner of another color for central void prevention can be limited to a part where a central void is likely to occur. Thus, it is possible to prevent central voids while enhancing the cost efficiency of the apparatus's operation.

According to the present invention, the color of toner that is added to develop part of a line forming a black-line image for central void prevention can be selected. Thus, it is possible to effectively prevent central voids without degrading image quality.

According to the present invention, it is possible to effectively prevent central voids even with toner produced by crushing and thus likely to cause central voids, or in a full-color image forming apparatus including a transfer belt as employed for compactness and other reasons.

What is claimed is:

1. A full-color image forming apparatus comprising:

an image signal input section for inputting an image signal;

an image formation section including an exposure section for shining image light based on the image signal inputted by the image signal input section on an image-carrying member and a development section for developing an electrostatic latent image formed on the image-carrying member by the exposure section; and a control section for controlling driving of the image formation section, wherein, when the image signal contains a black-line image, the control section develops the black-line image with black toner and in addition develops part of a line forming the black-line image with toner of another color laid over the black toner.

2. A full-color image forming apparatus of claim 1, wherein the part of the line forming the black-line image is a part corresponding to an intersection between at least two black lines and/or a middle portion of a black line.

3. A full-color image forming apparatus of claim 1, wherein the toner of the other color is toner of at least one of yellow, magenta, and cyan colors.

4. A full-color image forming apparatus of claim 1, wherein the black toner is produced by crushing, and the toner of the other color is produced by polymerization.

5. A full-color image forming apparatus of claim 1, further comprising:

an intermediary transfer member, wherein the electrostatic latent image formed on the image-carrying member is developed with toner of corresponding colors by the development section, and then resulting toner images are first transferred one over another onto the intermediary transfer member, and are then transferred all at once onto a transfer medium.

6. A full-color image forming apparatus of claim 5, wherein the intermediary transfer member is a belt.

7. A full-color image forming apparatus of claim 1, wherein, when the image signal represents a monochrome image, the control section does not develop the part of the line forming the black-line image with the toner of the other color laid over the black toner, but performs development with a smaller amount of black toner than when forming a full-color image.

* * * * *